US005397106A

United States Patent [19]

Hill

[11] Patent Number: 5,397,106

[45] Date of Patent: Mar. 14, 1995

[54] CUTTING AND COLLATING SHEETS OF PAPER

[75] Inventor: James Hill, Sheffield, United Kingdom

[73] Assignee: Rollem Patent Products Limited, Sheffield, United Kingdom

[21] Appl. No.: 84,409

[22] Filed: Jun. 29, 1993

[30] Foreign Application Priority Data

Jul. 2, 1992 [GB] United Kingdom ..... 9214080
Sep. 7, 1992 [GB] United Kingdom ..... 9219120

[51] Int. Cl.[6] ..... B65H 39/02; B26D 7/06
[52] U.S. Cl. ..... 270/58; 83/408
[58] Field of Search ..... 270/21.1, 52, 58; 83/408, 94; 271/251; 198/452

*Primary Examiner*—Edward K. Look
*Assistant Examiner*—John Ryznic
*Attorney, Agent, or Firm*—Trexler, Bushnell, Giangiorgi & Blackstone, Ltd.

[57] ABSTRACT

A machine for "bleed cutting" a sheet (1) into a plurality of pieces (2) and collating them by the method described and claimed in U.S. Pat. No. 4,405,121 has upper and lower pairs of slitting rollers in both the first series (12) and the second series (17) of slitting rollers, and transfer devices (201, 201') are provided within each path of pieces leaving the second series (17) of slitting rollers, with side gaps between the transfer devices within adjacent piece paths, and with end gaps between the second series (17) of slitting rollers and the transfer devices (201, 201'), whereby narrow side and end strips (101, 102) and tiny squares (103) formed by the pairs of lines (6) of cut by the second series (17) of slitting rollers across the pairs of lines (3) cut by the first series (12) of slitting rollers can fall away before the cut pieces (2) arrive at the transverse feed means (29).

16 Claims, 6 Drawing Sheets

CUTTING AND COLLATING SHEETS OF PAPER

This invention relates to cutting sheets of paper, or card or other material into a plurality of pieces in a plurality of rows and collating all the pieces from each sheet, by the method claimed in U.S. Pat. No. 4,405,121 which comprises first forming a plurality of slits extending in spaced relationship parallel to a first pair of opposite edges of the sheet, with all the slits ending short of the other pair of opposite edges of the sheet, next cutting along a plurality of lines parallel to that other pair of opposite edges and with at least two of the lines of cut intersecting the ends of the slits, then feeding the pieces in the lengthwise direction of the two marginal strips left beyond the respective ends of the cut ends of the slits and allowing these two strips to fall away, allowing the pieces at one end of these rows perpendicular to the direction of feed to drop to a level below the remaining pieces, superimposing a transverse feeding on the remaining pieces towards the dropped pieces, whereby the remaining pieces in the respective rows are dropped in order on to the respective initially dropped pieces, and finally allowing the batches of pieces to fall successively on to a substantially stationary support, whereby a stack of the pieces is formed in definite order.

The machine that is illustrated and described in U.S. Pat. No. 4,405,121 for carrying out the claimed method can perform "border slitting", which is when pictures on the pieces are surrounded by borders and slitting is effected in the middle of the double border widths between adjacent sides and adjacent ends of the pictures. This machine is provided with deflecting means for the two marginal strips of each sheet severed by the end slitting rollers of a second series of slitting rollers, these two strips being the only paper or card (etc.) discarded at the second cutting operation.

However, this machine cannot effectively perform "bleed slitting", which is when pictures on the pieces are not surrounded by any borders, and may even overlap or "bleed" into one another, in which case pairs of upper and lower slitting rollers in both the first and second series of slitting rollers are needed to cut side and end strips from between the pieces. Although deflecting means similar to those provided for the two strips of each sheet severed by the end slitting rollers of the second series might be provided for the shorter side strips from between adjacent sides of the pieces, parallel to the said marginal strips, it is not possible to provide deflecting means for the shorter end strips from between adjacent ends of the pieces transverse to the said marginal strips, because such deflecting means would also deflect the cut pieces, thus preventing entry of pieces into the transverse feed means.

One object of the present invention is to provide a cutting and collating machine capable of efficiently performing "bleed slitting".

Another object of the invention is to provide such a machine in which fully severed pieces cannot be pulled out of sequence by slitting rollers of the second series.

According to the present invention, a cutting and collating machine comprises a first series of slitting rollers on common axes, means for interrupting the slitting action of these rollers and means for timing the interruption with the feeding of a sheet perpendicularly to their axes to cause the sheet to receive a plurality of slits extending in spaced relationship parallel to a first pair of opposite edges of the sheet and with all the slits starting and ending short of the other pair of opposite edges of the sheet, means for feeding the sheet at right-angles to the slits to a second series of slitting rollers on common axes at right-angles to the axes of the first series of slitting rollers, with the end slitting rollers of the second series aligned with the ends of the slits made by the first series of slitting rollers, drive means for both series of slitting rollers, a conveyor having a forwarding run between leading and return drums respectively adjacent to and remote from the second series of slitting rollers, the forwarding run being at a level below that at which each sheet is fed to the second series of slitting rollers and aligned with the feed means so as to be able to receive one end row of cut pieces of a sheet in line astern, guide means along the forwarding run at or towards the side of the conveyor remote from the remaining rows of cut pieces of sheet, means for driving the conveyor at a speed not less than the peripheral speed of the second series of slitting rollers, transverse feed means for those remaining rows of cut pieces in a plane parallel to and above the plane for the forwarding run of the conveyor but not above the plane of the pieces at the second series of slitting rollers, the direction of feed of the transverse feed means being convergent with the forwarding run of the conveyor in the direction of movement of the latter, drive means for the transverse feed means at a speed such that each row of cut pieces therefrom is deposited in alignment on top of the row of cut pieces on the forwarding run of the conveyor, and a substantially stationary support adjacent to the return drum of the conveyor and below the level of the forwarding run so as to receive therefrom the batches of cut pieces of sheet in succession, together with transfer devices between the second series of slitting rollers on the one hand and the leading drum of the conveyor and the transverse feed means on the other hand, with at least one transfer device aligned within each path of pieces leaving the second series of slitting rollers, with side gaps between the transfer devices within adjacent piece paths, and end gaps between the second series of slitting rollers and the transfer devices.

When performing "bleed slitting", the machine according to the present invention will have—as indicated above—upper and lower pairs of slitting rollers in both the first and second series of slitting rollers, and, as the cut pieces are transferred from the second series of slitting rollers to the conveyor and transverse feed means by the transfer devices, the side strips can fall away through the side gaps between adjacent transfer devices, and the end strips can fall away through the end gaps between the second series of slitting rollers and the transfer devices. It will be evident that the end gaps are appreciably less in width (i.e. in the direction of travel of the cut pieces) than the length of the cut pieces, so that the cut pieces cannot fall away through the end gaps. It will also be evident that the side and/or end gaps are also adequate for the tiny squares from adjacent the corners of the cut pieces to fall away. A hopper may be provided below the transfer devices to catch the falling side and end strips and squares.

It will also be evident that the machine according to the invention can be set up for "border slitting" by providing slitting rollers in both the first and second series aligned with the middle of the double border widths between adjacent sides and adjacent ends of the pictures, because the transfer devices will still serve to transfer the cut pieces (i.e., pictures with borders) from the second series of slitting rollers to the conveyor and transverse feed means, without anything falling away except the two marginal strips beyond the ends of the slits formed by the first series of slitting rollers and severed by single extreme end slitting rollers of the second series.

Whether "bleed cutting" or "border cutting", in order to ensure uniformity of dimensions of all the pieces, the sheet is preferably also provided with marginal strips on the first pair of opposite edges removed by continuous cuts, formed by extreme end slitting rollers of the first series, simultaneously with the slits ending short of the other pair of opposite edges, formed by interrupted slitting rollers in the first series, these marginal strips being allowed to fall away before forming the cuts parallel to that other pair of edges by the second series of slitting rollers.

The spacing and/or number of transfer devices is preferably adjustable to suit changes in the size and/or number of pieces/pictures. Thus each transfer device, other than the one leading to the conveyor, may comprise a bracket with bolts for securing it anywhere along slots in a cross-member adjacent the transverse feed means, an idler pulley at the free end of the bracket, and a belt trained round the idler pulley and a drive roller extending parallel to the cross-member. Pressure rollers extending parallel to the drive roller may be used to urge the cut pieces into propelling contact with the belts of the transfer devices; preferably, however, balls are constrained on and in alignment with the belts of the transfer devices by a grid-like cage having a plurality of cross-slots and adjustable spacers located therein for location of the balls in vertical alignment centrally on the belts. The transfer device leading to the conveyor is very similar to the others but has its bracket mounted so that the top run of its belt is inclined downwardly from its idler pulley as is appropriate to the level of the forwarding run of the conveyor, and balls are constrained on and in alignment with the belt by holes in a bar carried by an overhead rail.

The conveyor and the transverse feed means may be as illustrated and described in U.S. Pat. No. 4,405,121, but a roller bed is preferably provided at the leading end of the transverse feed means, i.e., between the transfer devices (other than the one leading to the conveyor) and the transverse feed means, with driven rollers in the bed on axes parallel to the axes of the second series of slitting rollers, the rollers in the bed being driven (by means similar to that for the transverse feed means) at such a speed as will enable the spacing between the transverse rows of cut pieces to be increased beyond that caused by the end strips falling away before the cut pieces reach the transverse feed means. The first roller in the roller bed is conveniently the drive roller for the transfer devices, other than the one leading to the conveyor which has its own separate drive roller. Again, pressure rollers may be provided to urge the cut pieces into propelling contact with the driven rollers of the roller bed; preferably, however, balls are constrained in alignment with the driven rollers of the roller bed by a grid-like cage having a plurality of cross-slots and adjustable spacers located therein; and the grid-like cage for balls on the belts of the transfer devices may conveniently be an extension of the grid-like cage for balls on the driven rollers of the roller bed.

In order to ensure that there will be no "hang-up" of cut pieces/pictures between adjacent slitting rollers of the second series, all the pairs of upper and lower slitting rollers in the second series should be of the same hand throughout, i.e., all the cutting edges of the upper slitting rollers should be to the right (or to the left) of the cutting edges of the lower slitting rollers.

However, with this arrangement all the left hand edges of the strips/pieces will be depressed as they are cut, while all the right hand edges will be raised as they are cut (or vice versa), and in the case of narrow strips (e.g., about 5 to 10 mm wide) this can cause the strips to twist along their length—even to such an extent that some twisted strips curl themselves round the adjacent edges of wider pieces and get carried forward thereon (e.g., into the transverse feed means). Therefore, each upper pair of slitting rollers in the second series may be provided with a circular deflector disposed concentrically between and rotatable with the upper cutting edges, the outside diameter of the circular deflector being equal to or slightly greater than the diameter of the cutting edge on the upper slitting roller that depresses cut edges of the narrow strips, so that the circular deflector contacts the material being cut or before cutting of each narrow strip commences, the outside diameter of the circular deflector being set so that the slight deflection of the material limits the amount of twisting of each strip to an extent preventing it from curling round the adjacent edge of the piece from which it is being cut.

There is no need to eliminate twisting of the narrow strips; indeed, twisting along the length of the order of 90° assists in the discarding of the strips downwards, as the leading end of each strip reaching a vertical position reduces air resistance.

Each circular deflector may be formed by a disc (with a central hole for the shaft carrying the upper slitting rollers) or an annulus. The width (or thickness) of the deflector may be of the order of 1.5 mm, which enables the deflector to be secured to the associated slitting roller by domed head screws having a head height of at least 2.0 mm; however, the deflector may be secured by countersink head screws; and the deflector may be formed integrally with the associated cutting edge on a disc or annulus affording greater thickness for accommodating countersink head screws.

The lower slitting rollers of the second series are preferably bevelled from closely adjacent the adjacent cutting edges, to assist discarding downwards of the narrow end strips severed from the rows of pieces previously slit by interrupted cutting edges on the first series of paired upper and lower slitting rollers, in readiness for the cut pieces to proceed (without any narrow strips) to the transverse feed means.

In all other respects the machine according to the present invention is the same as the machine illustrated and described in U.S. Pat. No. 4,405,121.

An embodiment of the invention and a modification thereof will now be described, by way of example only, with reference to the accompanying drawings in which:

FIG. 1 is a diagrammatic plan illustrating how the method of U.S. Pat. No. 4,405,121 is adapted to bleed slitting;

Figure 7:
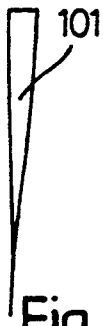
FIG. 7 is a plan illustrating acceptable twisting of narrow side strips leaving the second series of slitting rollers.
Figure 5:
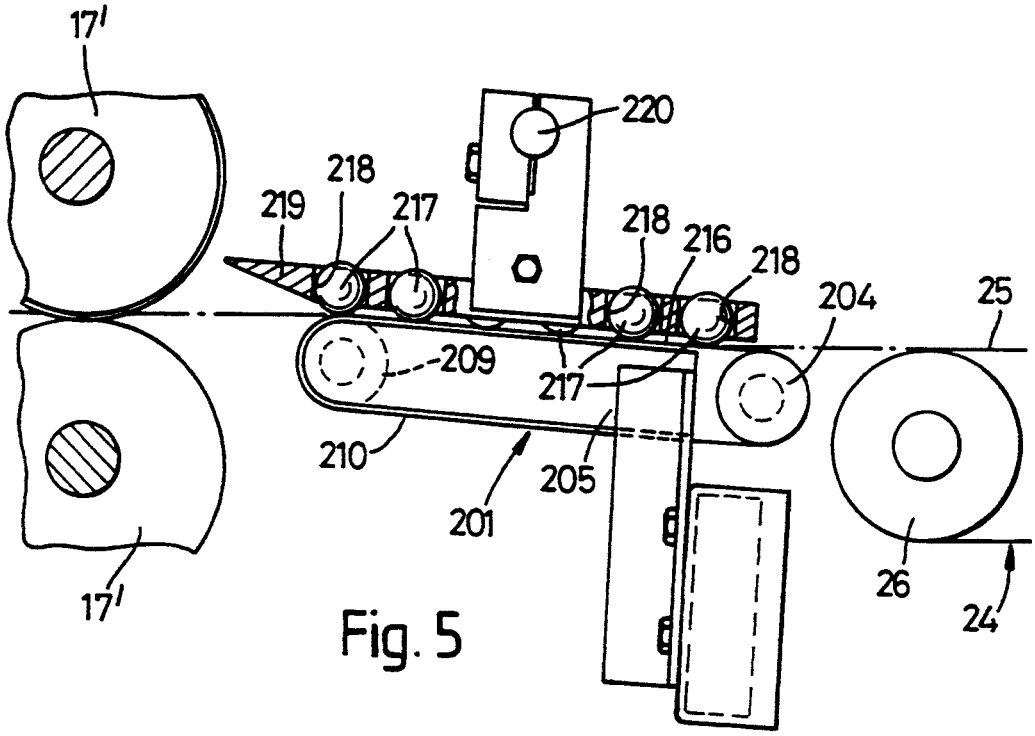
FIG. 5 is a part-sectional fragmentary elevation from the line V—V in FIG. 2 on a larger scale.
Figure 6:
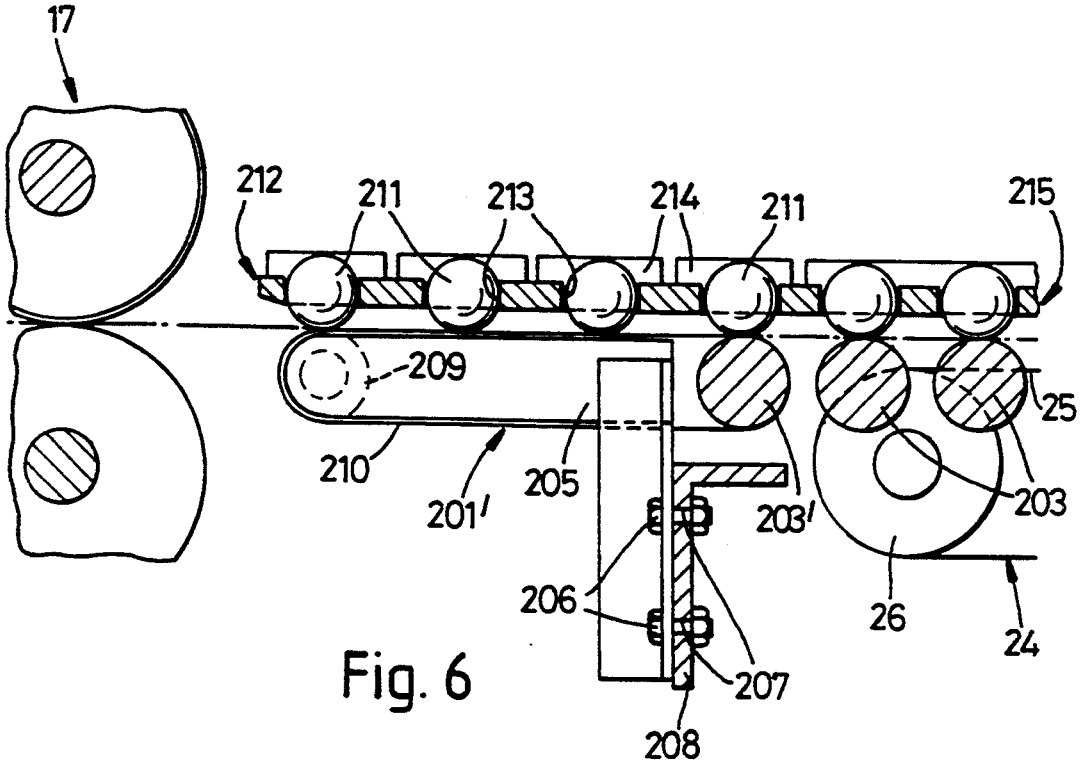
FIG. 6 is a similar view to FIG. 5 taken from the line VI—VI in FIG. 2.
Figure 9:
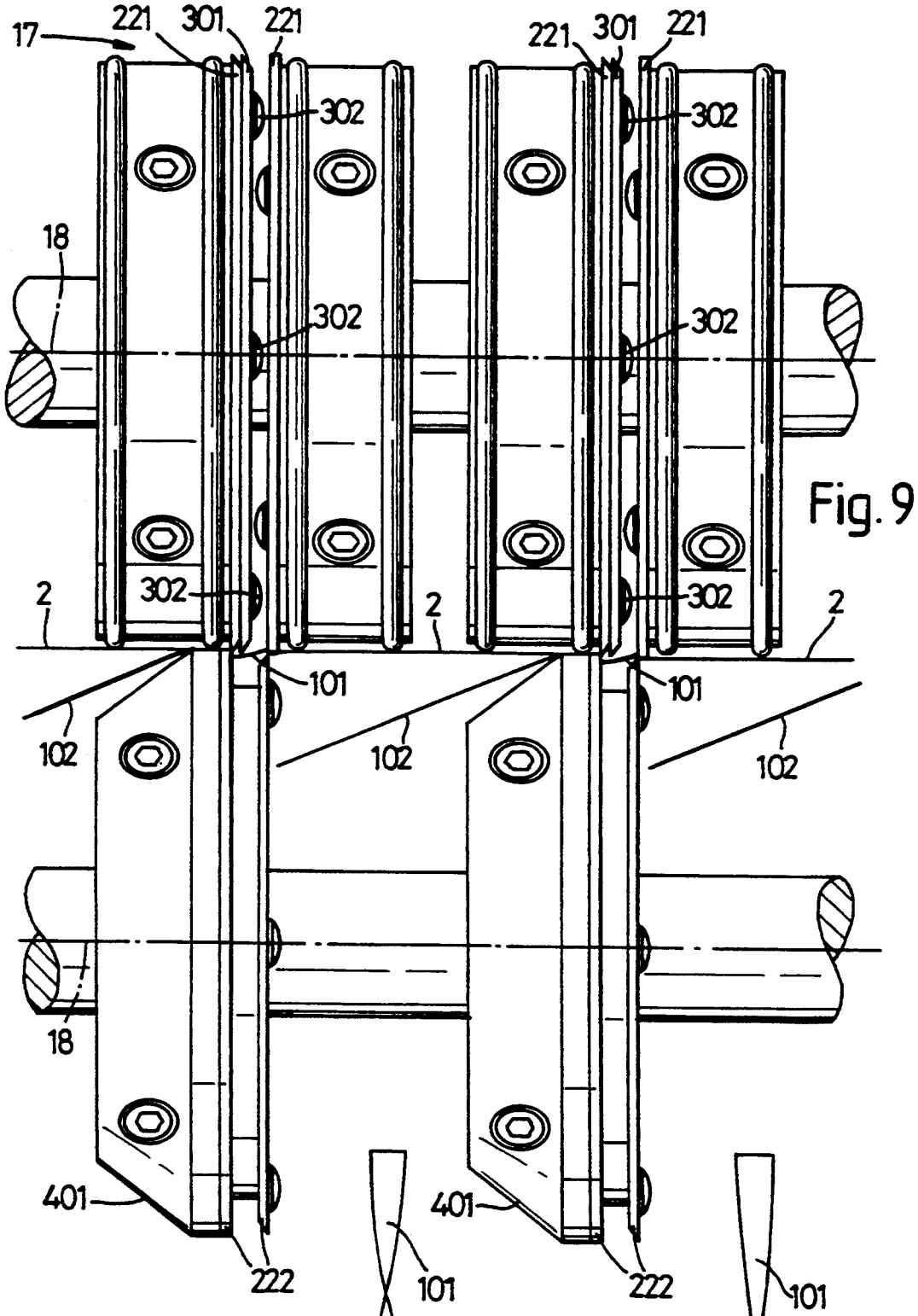
Figure 8:
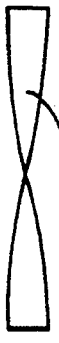
FIG. 8 is a similar plan illustrating unacceptable twisting of somewhat wider narrow side strips leaving the second series of slitting rollers.
Figure 10:
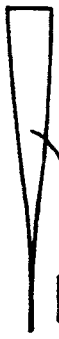

FIG. 9 is a full-scale fragmentary elevation of the second series of slitting rollers showing the inclusion of deflector discs capable of limiting twisting of such somewhat wider narrow side strips to an acceptable amount as illustrated by the plan of FIG. 10 similarly to that of FIG. 7; and FIG. 10 is a plan view similar to FIG. 8 but showing acceptable twisting of the somewhat wider narrow side strips upon leaving the second series of slitting rollers provided with deflector disks as shown in FIG. 9.

Figures 1, 1A:
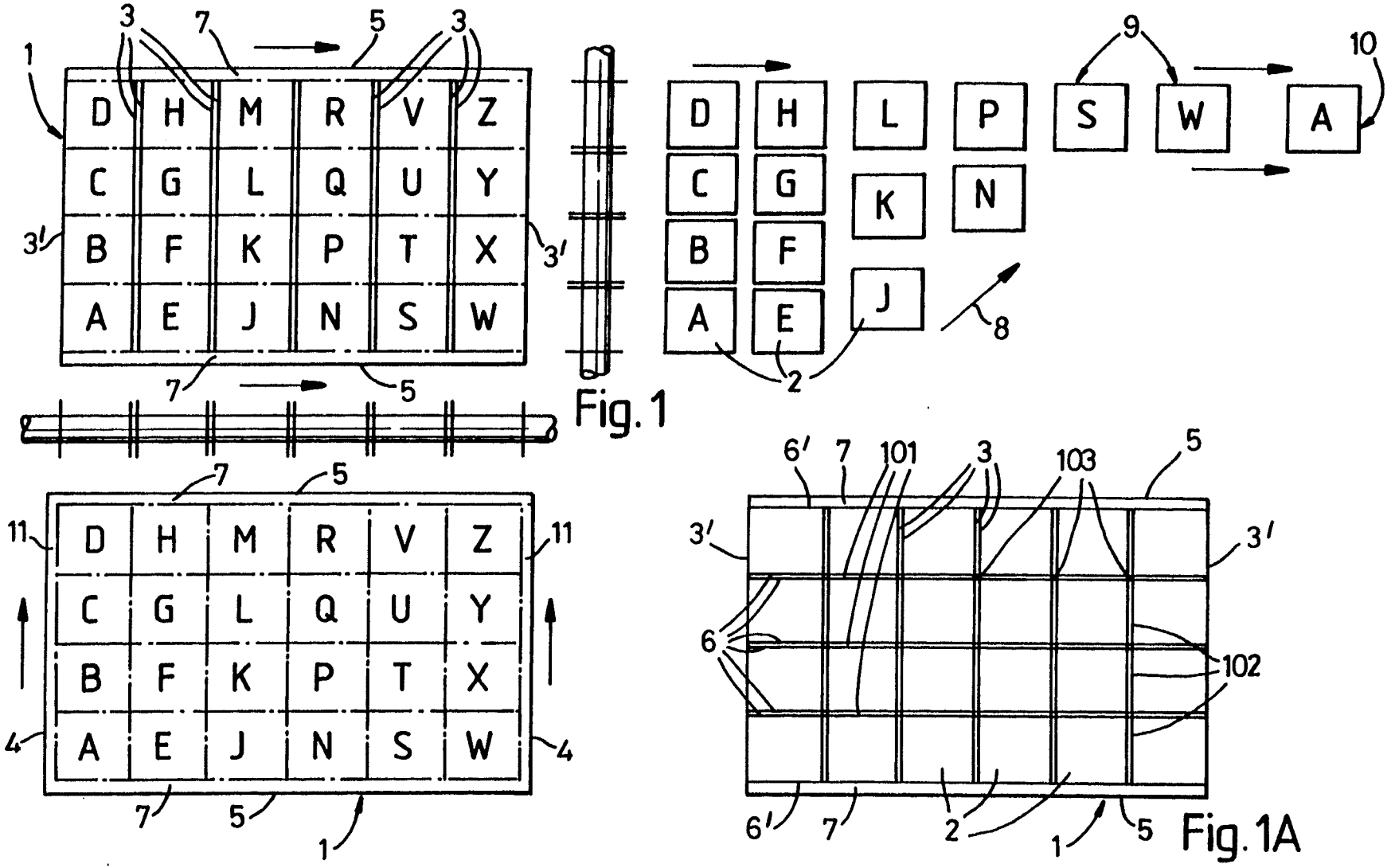
FIG. 1A is a theoretical diagram illustrating all the pieces and strips emerging from the second series of slitting rollers indicated in FIG. 1.
Figure 2:
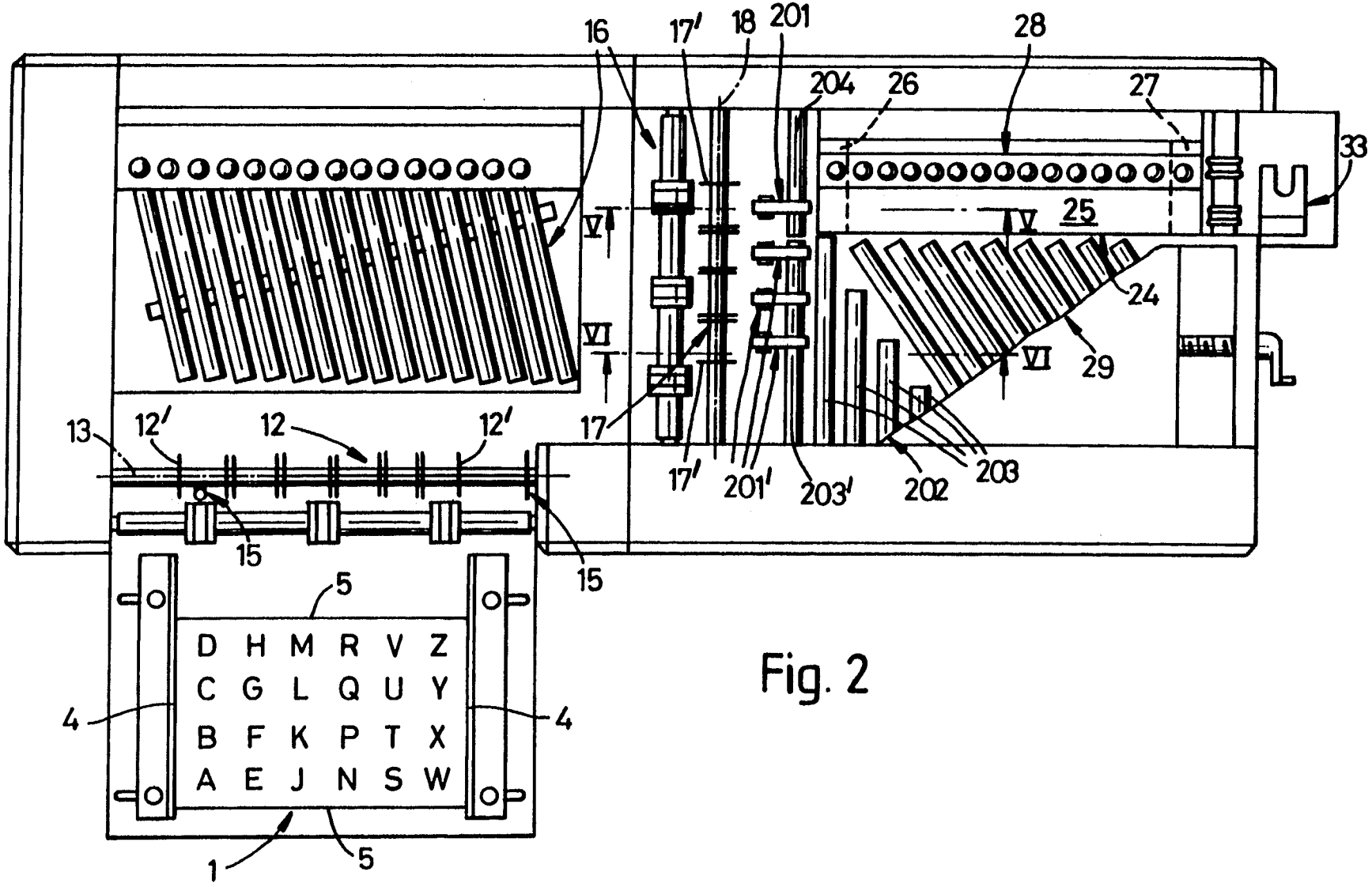
FIG. 2 is a diagrammatic plan of the preferred embodiment of machine in accordance with the present invention as adapted for bleed slitting.
Figure 3:
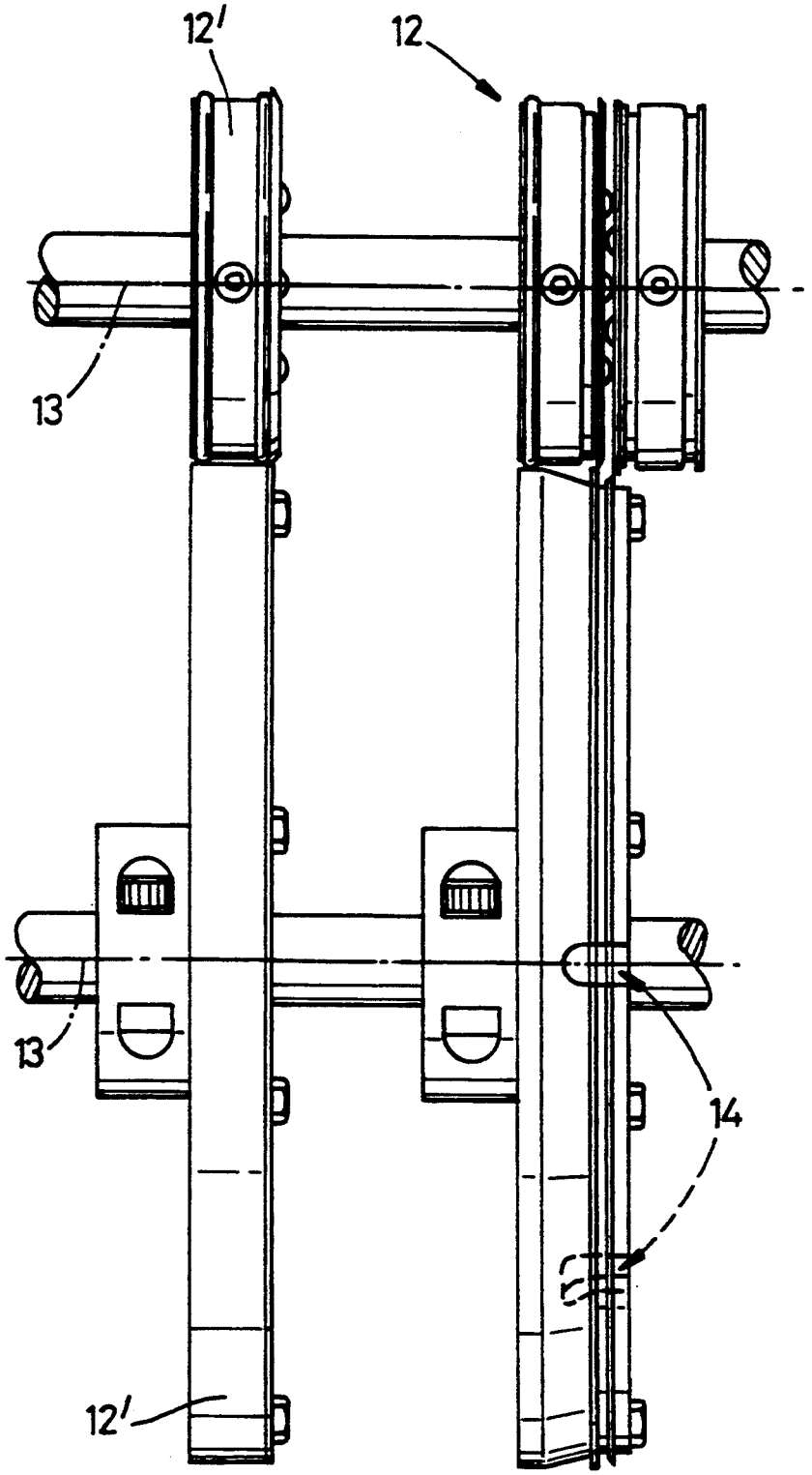
FIG. 3 is a half-scale fragmentary elevation of one end of the first series of slitting rollers of the machine shown in FIG. 2.

Referring to FIG. 1, the method of cutting the sheet into a plurality of pieces 2 in a plurality of rows and collating all the cut pieces is basically similar to that described and claimed in U.S. Pat. No. 4,405,121, except that, because assumed pictures on the pieces are assumed not to be surrounded by any borders (as indicated by the grid of chain-dotted lines) and may even overlap or "bleed" into one another, it is necessary first to form slits 3 in pairs extending in spaced relationship parallel to a first pair of opposite edges 4 of the sheet, with all the slits 3 ending short of the other pair of opposite edges 5 of the sheet. At the same time, marginal strips 11 are completely cut off along lines 3' and allowed to fall away. Next, cutting is effected along pairs of lines 6 (see FIG. 1A) parallel to that other pair of opposite edges 5, and at the same time two single cuts are made along lines 6' intersecting the ends of the slits 3, 3' and then allowing the two marginal strips 7 to fall away, as well as the narrow side and end strips 101, 102 respectively and the tiny squares 103 from between the pieces 2 as the latter are fed in the lengthwise direction of the two strips 7 and the side strips 101. The pieces 2 at one end of the rows perpendicular to the direction of feed (i.e., those marked D, H, M, R, V, Z) are allowed to drop to a level below the remaining pieces 2, which are then also subject to a transverse feeding towards the dropped pieces (the resultant feed direction being indicated by the arrow 8), whereby the remaining pieces in the respective rows are dropped in order on to the respective initially dropped pieces. And, finally, the batches 9 of pieces are allowed to fall successively on to a stationary support, whereby a stack 10 of the pieces 2 is formed in definite order.

The pieces allowed to drop to a level below the remaining pieces (i.e., those marked D, H, M, R, V, Z) may be subjected to the transverse feeding in order to bring them to the positions at which they drop, as is the case in FIG. 1 of U.S. Pat. No. 4,405,121. In the present FIG. 1 the pieces marked D, H, M, R, V, Z are assumed to drop to a lower level simply as they are fed in the lengthwise direction of the two marginal strips 7.

Referring to FIGS. 2 to 6 (in which like parts in the machine of the aforesaid U.S. Patent have been given generally like reference numerals) the cutting and collating machine comprises a first series 12 of upper and lower slitting rollers on common axes 13, means 14 for interrupting the slitting action of these rollers (except for the end ones 12' which form the cuts 3') and means 15 (not shown in detail but as in the machine of the aforesaid U.S. Patent) for timing the interruption with the feeding of the sheet 1 perpendicularly to the axes 13 to cause the sheet to receive the plurality of pairs of slits 3 ending short of the edges 5 of the sheet, means 16 for feeding the sheet at right angles to the slits 3 to a second series 17 of upper and lower slitting rollers on common axes 18 at right-angles to the axes 13 of the first series 12 of slitting rollers, with the end slitting rollers 17' of the second series 17 aligned with the ends of the slits 3 made by the first series 12 of slitting rollers, drive means (not shown but as in the aforesaid U.S. Patent) for both series of slitting rollers 12, 17, a conveyor 24 having a forwarding run 25 between leading the return drums 26, 27 respectively adjacent to and remote from the second series 17 of slitting rollers, the forwarding run 25 being at a level below that at which each sheet 1 is fed to the second series 17 of slitting rollers and aligned with the feed means 16 so as to be able to receive the end row of cut pieces 2 marked D, H, M, R, V, Z in line astern, guide means 28 along the forwarding run 25 at or towards the side of the conveyor 24 remote from the remaining rows of cut pieces 2, means (not shown but as in the aforesaid U.S. Patent) for driving the conveyor 24 at a speed not less than the peripheral speed of the second series 17 of slitting rollers (but preferably at a slightly greater speed to achieve a greater separation of the pieces 2 falling on it than provided by the falling away of the end strips 102 from between them), transverse feed means 29 for those remaining rows of cut pieces 2 in a plane parallel to and above the plane of the forwarding run 25 of the conveyor but not above the plane of the pieces at the second series 17 of slitting rollers, the direction of feed of the transverse feed means 29 being convergent with the forwarding run of the conveyor in the direction of movement of the latter, drive means (likewise not shown but as in the aforesaid U.S. Patent) for the transverse feed means at a speed such that each row of cut pieces 2 therefrom is deposited in alignment on top of the row of cut pieces on the forwarding run of the conveyor, and a stationary support 33 adjacent to the return drum 27 of the conveyor and below the level of the forwarding run 25 so as to receive therefrom the batches 9 of cut pieces 2 in succession and from them into a stack 10 in definite order, together with transfer devices 201, 201' between the second series 17 of slitting rollers on the one hand and the leading drum 26 of the conveyor 24 and the transverse feed means 29 on the other hand, with at least one transfer device aligned within each path of pieces 2 leaving the second series 17 of slitting rollers, with side gaps between the transfer devices within adjacent piece paths, and end gaps between the second series of slitting rollers and the transfer devices.

As the cut pieces 2 are transferred from the second series 17 of slitting rollers to the conveyor 24 and transverse feed means 29 by the transfer devices 201, 201', the side strips 101 can fall away through the side gaps and the end strips 102 can fall away through the end gaps, while, of course, there will also be room through the side gaps and/or end gaps for the tiny squares 103 to fall away. A hopper (not shown) is preferably provided below the transfer devices 201, 201' to collect all the strips 101, 102 and squares 103.

A roller bed 202 is provided at the leading end of the transverse feed means 29, i.e., between the transfer devices 201 and the transverse feed means, with driven rollers 203 in the bed on axes parallel to the axes 18 of the second series 17 of slitting rollers, the rollers in the bed being driven (by means not shown but similar to that for the transverse feed means 29) at such a speed as will enable the spacing between the transverse rows of cut pieces 2 to be increased before they reach the transverse feed means. The first roller 203' in the roller bed conveniently drives the transfer devices 201', but not the transfer device 201 leading to the conveyor, which transfer device has its own drive roller 204 driven by means not shown but affording the same speed to the transfer device 201 as is afforded to the transfer devices 201' (see particularly FIGS. 5 and 6).

Each transfer device 201' has a bracket 205 with bolts 206 for securing it anywhere along slots 207 in a cross-member 208 adjacent the transverse feed means 29, an idler pulley 209 at the free end of the bracket, and a belt 210 trained round the idler pulley and the drive roller 203' (which is the first driven roller of the roller bed 202 at the leading end of the transverse feed means). Balls 211 are constrained on and in alignment with the belts 210 of the transfer devices 201' by a grid-like cage 212 having a plurality of cross-slots 213 and adjustable spacers 214 located therein for location of the balls in vertical alignment centrally of the belts. The grid-like cage 212 is conveniently an extension of a grid-like cage 215 for balls (with spacers) on the driven rollers 203 of the roller bed 202.

The transfer device 201 leading to the conveyor 24 is very similar to the others but has its bracket 205 mounted so that the top run 216 of its belt 210 is inclined downwardly from its idler pulley 209 as is appropriate to the level of the forwarding run 25 of the conveyor 24, and balls 217 are constrained on and in alignment with the belt by holes 218 in a bar 219 carried by an overhead rail 220.

Figure 4:
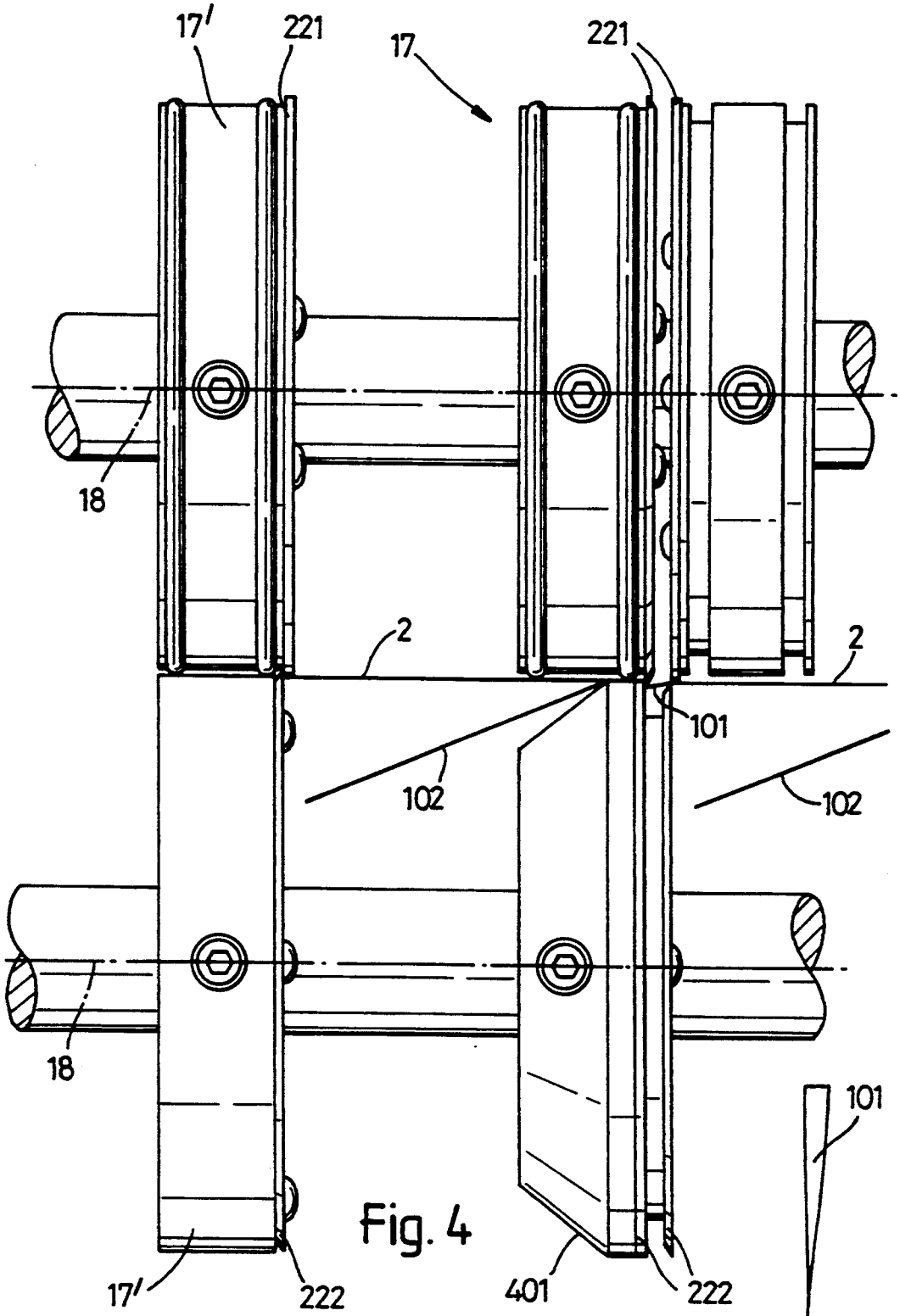
FIG. 4 is a full-scale fragmentary elevation of one end of the second series of slitting rollers of the machine.

In order to ensure that there will be no "hang-up" of pieces 2 or strips 101, 102 between adjacent slitting rollers of the second series 17, all the pairs of upper and lower slitting rollers in the second series are of the same hand throughout, i.e., all the cutting edges 221 of the upper slitting rollers are to the right of the cutting edges 222 of the lower slitting rollers, as seen in FIG. 4. With this arrangement all the left hand edges of the side strips 101 and of the cut pieces 2 will be depressed as they are cut, while all the right hand edges will be raised as they are cut. This will cause the side strips 101 to twist, but in the case of strips of less than 5 mm width this has not proved detrimental because twisting along the length of the order of 90° (e.g., as shown in FIG. 7) assists in the discarding of the strips downwards, as the leading end of each strip reaching a vertical position reduces air resistance.

With "wider" strips 101 (e.g., about 5 to 10 mm wide), however, this phenomenon has proved detrimental in that it has been known to cause twisting to such an extent (e.g., 180°, as shown in FIG. 8 or more) that some side strips 101 curl themselves round the adjacent edges of cut pieces 2 and get carried forward thereon into the transverse feed means 29. Therefore, as shown in FIG. 9, each upper pair of slitting rollers in the second series 17 may be provided with a circular deflector 301 disposed concentrically between and rotatable with the upper cutting edges 221, the outside diameter of the deflector 301 being equal to or slightly greater than the diameter of the cutting edge that depresses cut edges of the side strips 101, so that the deflector contacts the material being cut or before cutting of each narrow strip commences, the outside diameter of the deflector being set so that the slight deflection of the material that it causes limits the amount of twisting of each strip 101 to an extent (e.g., 90° along its length, as shown in FIG. 10) preventing it from curling round the adjacent edge of a piece 2 from which it is being cut.

Each circular deflector 301 is formed by a disc or annulus, the width (or thickness) of which is of the order of 1.5 mm enabling it to be secured to the associated slitting roller by domed head screws 302 having a head height of at least 2.0 mm.

Lower slitting rollers are shown bevelled at 401 in FIGS. 4 and 9 from closely adjacent the adjacent cutting edges 222, to assist discarding of the narrow end strips 102, in readiness for the cut pieces 2 to proceed (without any narrow strips) to the transverse feed means 29.

What I claim is:

1. A cutting and collating machine comprises a first series of slitting rollers on common axes, means for interrupting the slitting action of these rollers and means for timing the interruption with the feeding of a sheet perpendicularly to their axes to cause the sheet to receive a plurality of slits extending in spaced relationship parallel to a first pair of opposite edges of the sheet and with all the slits starting and ending short of the other pair of opposite edges of the sheet, means for feeding the sheet at right-angles to the slits to a second series of slitting rollers on common axes at right-angles to the axes of the first series of slitting rollers, with the end slitting rollers of the second series aligned with the ends of the slits made by the first series of slitting rollers, drive means for both series of slitting rollers, a conveyor having a forwarding run between leading and return drums respectively adjacent to and remote from the second series of slitting rollers, the forwarding run being at a level below that at which each sheet is fed to the second series of slitting rollers and aligned with the feed means so as to be able to receive one end row of cut pieces of a sheet in line astern, guide means along the forwarding run at or towards the side of the conveyor remote from the remaining rows of cut pieces of sheet, means for driving the conveyor at a speed not less than the peripheral speed of the second series of slitting rollers, transverse feed means for those remaining rows of cut pieces in a plane parallel to and above the plane for the forwarding run of the conveyor but not above the plane of the pieces at the second series of slitting rollers, the direction of feed of the transverse feed means being convergent with the forwarding run of the conveyor in the direction of movement of the latter, drive means for the transverse feed means at a speed such that each row of cut pieces therefrom is deposited in alignment on top of the row of cut pieces on the forwarding run of the conveyor, and a substantially stationary support adjacent to the return drum of the conveyor and below the level of the forwarding run so as to receive therefrom the batches of cut pieces of sheet in succession, together with transfer devices between the second series of slitting rollers on the one hand and the leading drum of the conveyor and the transverse feed means on the other hand, with at least one transfer device aligned within each path of pieces leaving the second series of slitting rollers, with side gaps between the transfer devices within adjacent piece paths, and end gaps between the second series of slitting rollers and the transfer devices.

2. A machine as in claim 1, wherein upper and lower pairs of slitting rollers are provided in both the first and second series of slitting rollers.

3. A machine as in claim 2, wherein a hopper is provided below the transfer devices.

4. A machine as in claim 1, wherein the spacing and/or number of transfer devices is adjustable to suit changes in the size and/or number of pieces/pictures.

5. A machine as in claim 4, wherein each transfer device, other than the one leading to the conveyor, comprises a bracket with bolts for securing it anywhere along slots in a cross-member adjacent the transverse feed means, an idler pulley at the free end of the bracket, and a belt trained round the idler pulley and a drive roller extending parallel to the cross-member.

6. A machine as in claim 5, wherein pressure rollers extending parallel to the drive roller are used to urge the cut pieces into propelling contact with the belts of the transfer devices.

7. A machine as in claim 5, wherein balls are constrained on and in alignment with the belts of the transfer devices by a grid-like cage having a plurality of cross-slots and adjustable spacers located therein for location of the balls in vertical alignment centrally on the belts.

8. A machine as in claim 6, wherein the transfer device leading to the conveyor is very similar to the others but has its bracket mounted so that the top run of its belt is inclined downwardly from its idler pulley as is appropriate to the level of the forwarding run of the conveyor, and balls are constrained on and in alignment with the belt by holes in a bar carried by an overhead rail.

9. A machine as in claim 1, wherein a roller bed is provided at the leading end of the transverse feed means, with driven rollers in the bed on axes parallel to the axes of the second series of slitting rollers, the rollers in the bed being driven at such a speed as will enable the spacing between the transverse rows of cut pieces to be increased beyond that caused by the end strips falling away before the cut pieces reach the transverse feed means.

10. A machine as in claims 5 or 9, in combination, wherein the first roller in the roller bed is the drive roller for the transfer devices, other than the one leading to the conveyor which has its own separate drive roller.

11. A machine as in claim 9, wherein pressure rollers are provided to urge the cut pieces into propelling contact with the driven rollers of the roller bed.

12. A machine as in claim 9, wherein balls are constrained in alignment with the driven rollers of the roller bed by a grid-like cage having a plurality of cross-slots and adjustable spacers located therein.

13. A machine as in claims 7 or 12 in combination, wherein the grid-like cage for balls on the belts of the transfer devices is an extension of the grid-like cage for balls on the driven rollers of the roller bed.

14. A machine as in claim 2, wherein all the pairs of upper and lower slitting rollers in the second series are of the same hand throughout.

15. A machine as in claim 14, wherein each upper pair of slitting rollers in the second series is provided with a circular deflector disposed concentrically between and rotatable with the upper cutting edges, the outside diameter of the circular deflector being equal to or slightly greater than the diameter of the cutting edge on the upper slitting roller that depresses cut edges of the narrow strips, so that the circular deflector contacts the material being cut or before cutting of each narrow strip commences, the outside diameter of the circular deflector being set so that the slight deflection of the material limits the amount of twisting of each strip to an extent preventing it from curling round the adjacent edge of the piece from which it is being cut.

16. A machine as in claim 14 or claim 15, wherein the lower slitting rollers of the second series are preferably bevelled from closely adjacent the adjacent cutting edges.

* * * * *